US007013566B1

(12) United States Patent
Bellm et al.

(10) Patent No.: US 7,013,566 B1
(45) Date of Patent: Mar. 21, 2006

(54) ROTARY CUTTING DEVICE AND METHOD FOR MAKING SAME

(76) Inventors: Mark Bellm, 3500 Oak Grove Cir., Westcliffe, CO (US) 81252; Matthew Herbert Elliott, 214 S. Michigan Ave., Edgerton, OH (US) 43517; Steven Oren Elliott, 815 Wesley Ave., Bryan, OH (US) 43517

( * ) Notice: Subject to any disclaimer, the term of this patent is extended or adjusted under 35 U.S.C. 154(b) by 89 days.

(21) Appl. No.: 10/682,314

(22) Filed: Oct. 8, 2003

Related U.S. Application Data

(60) Provisional application No. 60/417,262, filed on Oct. 8, 2002.

(51) Int. Cl.
*B26B 19/14* (2006.01)

(52) U.S. Cl. ..... 30/29.5; 30/43.6

(58) Field of Classification Search ..... 30/29.5, 30/43.4, 43.5, 43.6, 240, 263, 264, 265, 205, 30/206
See application file for complete search history.

(56) References Cited

U.S. PATENT DOCUMENTS

| | | | | | |
|---|---|---|---|---|---|
| 1,799,907 | A | * | 4/1931 | Kaufmann | 30/29.5 |
| 2,015,160 | A | | 9/1935 | Shaler | |
| D109,384 | S | | 4/1938 | Aronson | |
| 2,212,856 | A | * | 8/1940 | Dalkowitz | 30/29.5 |
| 2,564,379 | A | | 7/1951 | Smith | |
| 2,759,259 | A | * | 8/1956 | McDermott | 30/29.5 |
| 2,764,811 | A | * | 10/1956 | Guardino | 30/29.5 |
| 2,801,465 | A | | 8/1957 | Cason | |
| D189,666 | S | | 1/1961 | Edwards | |
| 2,987,818 | A | * | 6/1961 | Rosenstein | 30/537 |
| 3,085,328 | A | * | 4/1963 | Strike | 30/29.5 |
| 3,524,253 | A | * | 8/1970 | Hoke | 30/29.5 |
| 3,965,569 | A | * | 6/1976 | Bolduc | 30/29.5 |
| 4,571,827 | A | | 2/1986 | Lee | |
| D305,162 | S | | 12/1989 | Mockovak | |
| 5,012,576 | A | | 5/1991 | Johannesson | |
| D339,212 | S | | 9/1993 | Carleton | |
| 5,255,437 | A | * | 10/1993 | Chen | 30/29.5 |
| D342,345 | S | | 12/1993 | Yonezawa | |
| D376,670 | S | | 12/1996 | Bellm et al. | |
| 5,655,301 | A | | 8/1997 | Dickson | |
| 6,067,714 | A | * | 5/2000 | Taylor et al. | 30/29.5 |

* cited by examiner

*Primary Examiner*—Hwei-Siu Payer
(74) *Attorney, Agent, or Firm*—Marger Johnson & McCollom, PC

(57) ABSTRACT

A nose hair trimmer and method for making the same. A generally cylindrical external cutting head has a central bore therethrough. An internal cutting head is received in the central bore the external and internal heads have pluralities of cutting teeth disposed thereon, which pluralities are relatively prime numbers. A method for making the nose hair trimmer is also provided, in which a mandrel is positioned within the central bore of the external head and external teeth bead-blasted.

15 Claims, 12 Drawing Sheets

ROTARY CUTTING DEVICE AND METHOD FOR MAKING SAME

This application claims benefit of U.S. provisional application Ser. No. 60/417,262 filed on Oct. 8, 2002.

BACKGROUND OF THE INVENTION

The present invention is related to the field of rotary cutting devices, and more specifically to a blade assembly for a rotary cutter and a method for making same.

Trimmers are known in the prior art and have varied uses, e.g. cutting nose and ear hairs, use in arthroscopic and other medical procedures. The main structural components include a generally cylindrical external head having blades or cutting teeth thereon, and a generally cylindrical internal cutting head having blades or cutting teeth thereon.

Referring to U.S. Pat. No. 5,655,301, the general manner in which a personal trimmer is used includes gripping surface 3 between the thumb and forefinger of one hand and gripping surface 3 between the thumb and forefinger of the other hand. For trimming nose hairs, the cutting end of the rotary trimmer is inserted approximately ⅛ inch into one of the user's nostrils. An external head is held in place while an internal head is rotated back and forth by the user. Such rotation turns the internal cutting head relative to the external cutting head, thereby cutting hairs in a known manner.

Other embodiments of a rotary cutting device, such as a mechanical tissue ablation implement, are functionally similar.

It is desirable that a rotary trimmer cleanly cut material without pulling or binding of the material between the cutting blades. It is further desired that the cutting action be efficient, reducing the effort required to rotate the cutting blades.

The invention will become more readily apparent from the following Detailed Description, which proceeds with reference to the drawings, in which:

DETAILED DESCRIPTION OF THE PREFERRED EMBODIMENT(S)

Figure 1B:
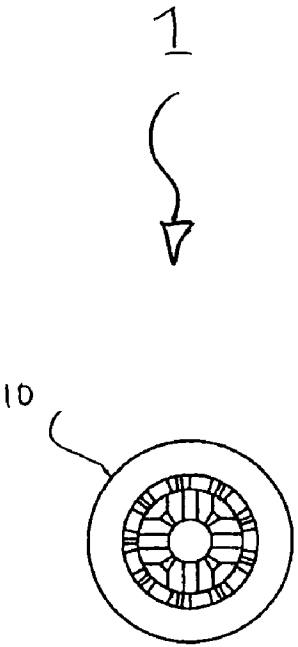
FIGS. 1A–1B are side and end view diagrams, respectively, of one embodiment of a rotary hair trimmer according to the present disclosure.

Generally, the present invention provides a rotary cutting device and, more particularly, a rotary cutting device having relatively prime numbers of inner and outer cutting teeth.

In a first embodiment shown in FIGS. 1A–3B, a rotary cutting device, such as personal hair trimmer 1, includes external head 10 and internal head 20. A conventional trimmer of this construction typically has means for rotating the heads relative to one another, such as shaft 24. Further elements, such as gripping elements 3 and retaining pin 4, can also be found in rotary trimmer 1.

In the embodiment of FIGS. 1A–3B, internal head 20 has shaft 24 attached thereto and extending through central bore 14. Internal cutting head 22 is disposed at one end of shaft 24, with gripping means 3 at a second end.

Rotary trimmer 1 operates by relative rotation of external head 10 and internal head 20. Cutting surfaces thereon pass one another, cutting interposed material in a scissoring action. The cutting surfaces now will be examined in more detail.

Figure 4:
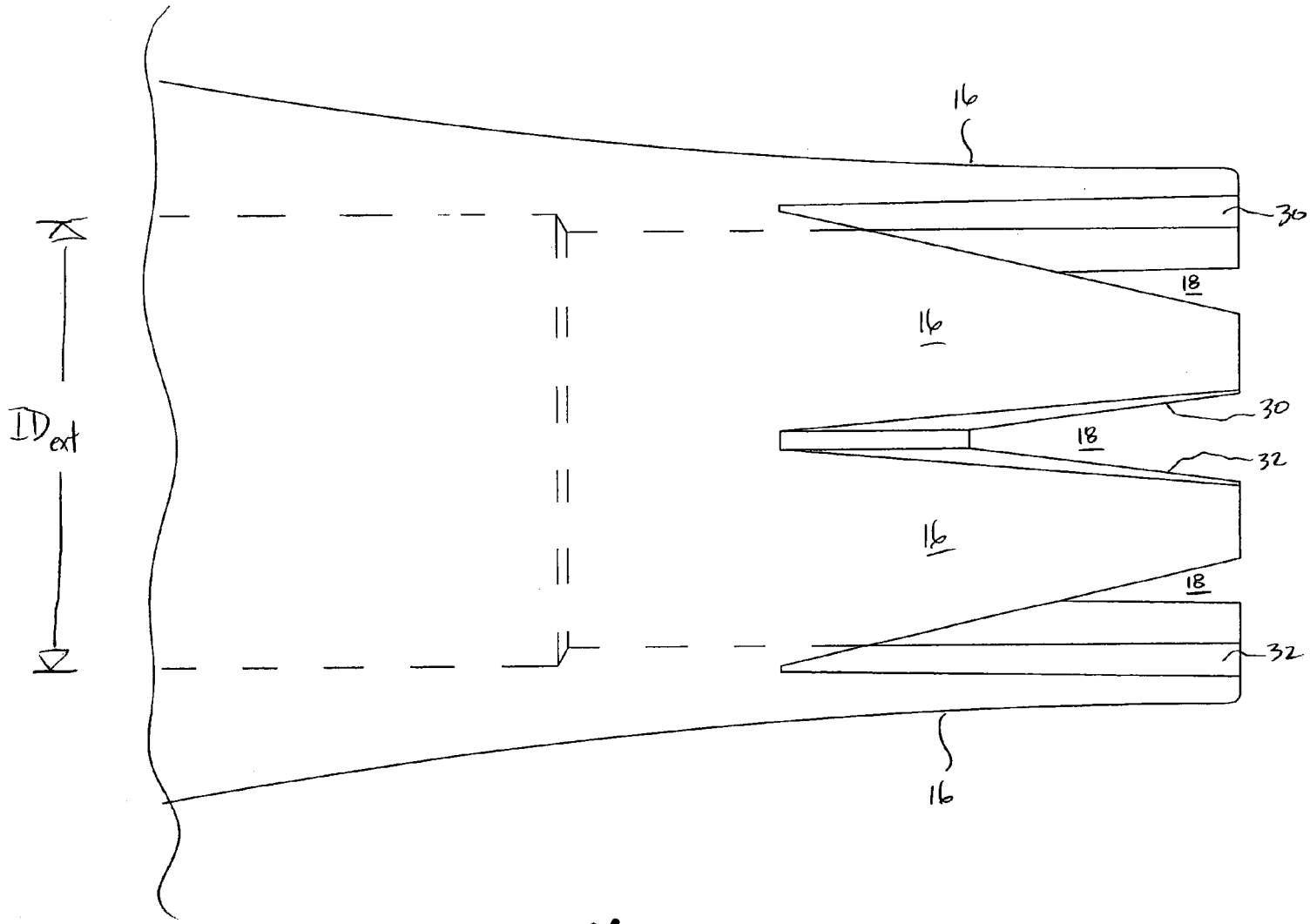
FIG. 4 is an enlarged partial view of the external head of FIGS. 1A–1B.

Turning to the cutting heads more specifically, FIG. 4 is an enlarged side view of external cutting head 10 of rotary trimmer 1. External head 10 is generally of a cylindrical structure having central bore 14 with inside diameter $ID_{EXT}$. External head 10 further includes a plurality $n_{EXT}$ of external cutting teeth 16, circularly arrayed on one end of the cutting head. Cutting teeth 16 define openings 18, through which a material to be cut can be positioned.

For simplicity of discussion, internal cutting head 20 is assumed to rotate against fixed external cutting head 10. It is readily appreciated that the converse can be employed, or that both external cutting head 10 and internal cutting head 20 can rotate to effect cutting.

Each external cutting tooth 16 has a leading cutting edge 30, and can also have a trailing cutting edge 32 (FIG. 4). Disposing both cutting edges on a tooth permits bidirectional rotational use of the rotary cutting device.

Figure 5:
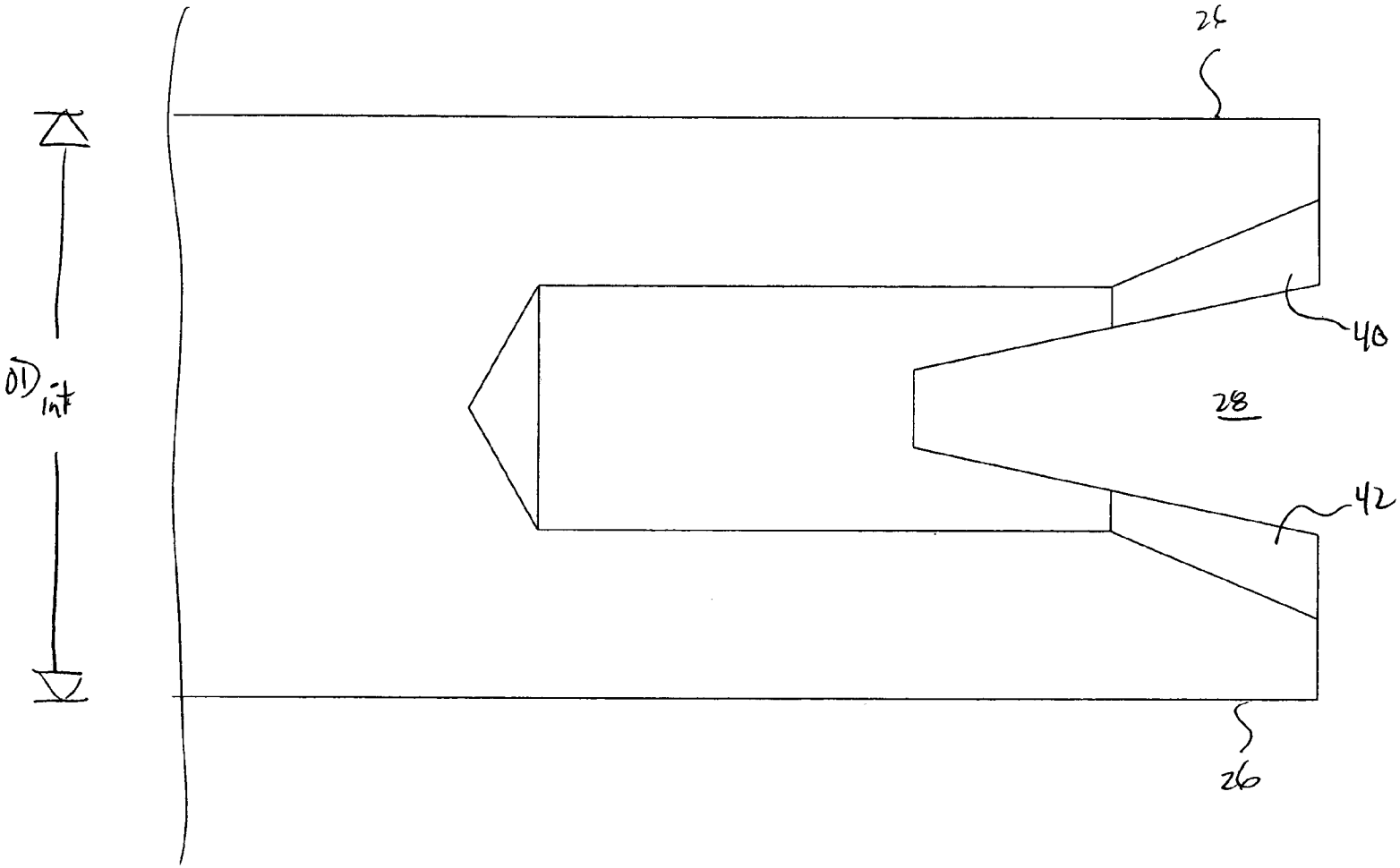
FIG. 5 is an enlarged partial view of the internal head of FIGS. 1A–1B.

In FIG. 5, internal cutting head 20, in this embodiment, likewise is a cylindrical structure having outside diameter $OD_{INT}$. Internal head 20 has a plurality $n_{INT}$ of internal cutting teeth 26 circularly arrayed thereon. Teeth 26 also define openings 28, through which the material can be positioned for cutting.

Each internal cutting tooth 26 similarly possesses a leading cutting edge 42, disposed to slide against leading cutting edge 30 of external cutting tooth 16. Material, interposed between leading cutting edge 42 and leading cutting edge 30, is cut when the heads are rotated in opposite directions.

It is preferable that $n_{INT}$ and $N_{EXT}$ be relatively prime—that is, that $n_{INT}$ and $N_{EXT}$ have no common divisors. By contrast, prior art devices generally have numbers of internal openings and external cutting teeth which are not relatively prime.

For example, where $n_{INT}$ is 4, $n_{EXT}$ can be 5, 7, 9 and 11, with $N_{INT}$ most preferably equal to 9. Where $N_{INT}$ is 3, then $n_{EXT}$ can be 4, 5, 7, 8, 10 and 11. If $N_{INT}$ is 5, appropriate relatively prime numbers for $n_{EXT}$ include 4, 6, 7, 8, 9 and 11.

The present structure results in alignment of no more than one external leading edge 30 and one internal trailing edge 40 in any rotational position. Conventional rotary cutting devices, having non-relatively prime numbers of external and internal cutting teeth, permit a plurality of such simultaneous alignments.

Figure 7B:
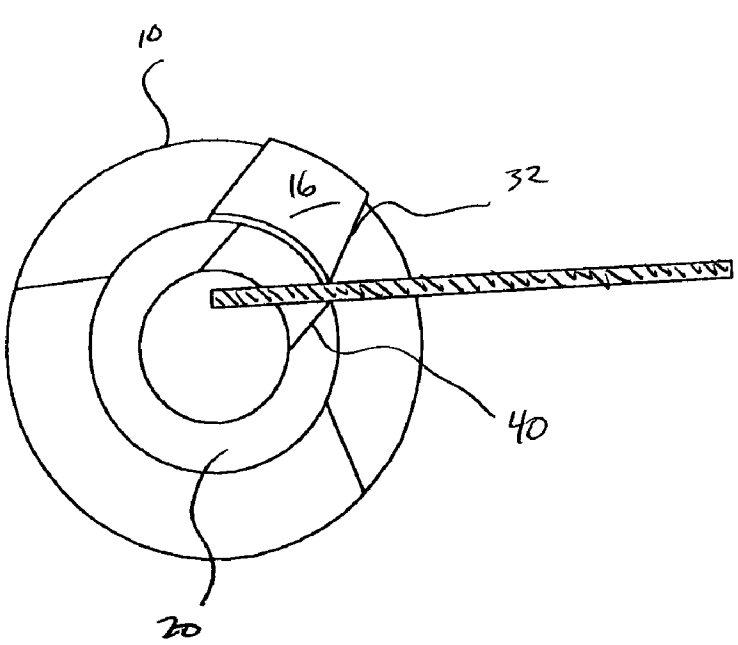
FIG. 7B (PRIOR ART)
Figure 7A:
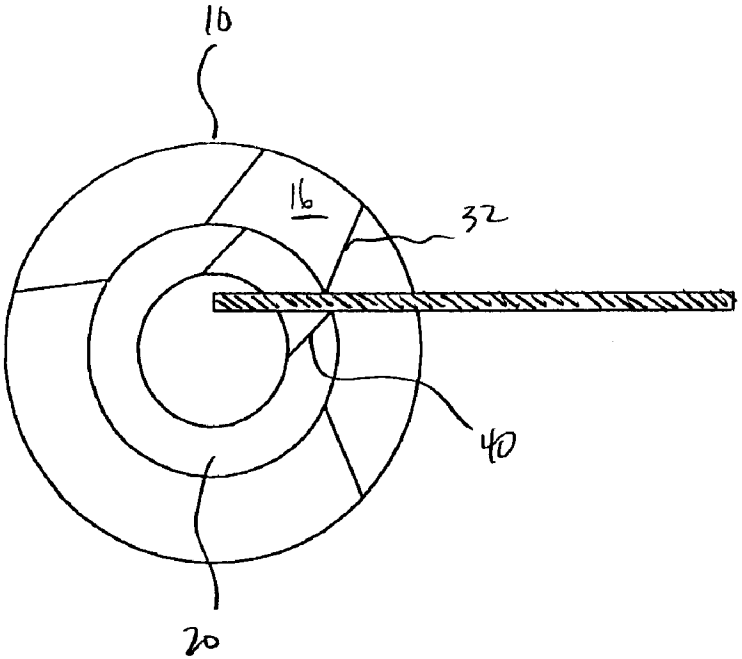
FIG. 7A (PRIOR ART)

A personal hair trimmer, such as that disclosed in U.S. Pat. No. 5,655,301, generally has an external cutting head diameter limited by the functional need for the cutting assembly to fit within the user's nostril. Given this restriction on diameter, increasing $n_{ext}$ will reduce the size of openings 18. It thus becomes less likely that a hair can be interposed within the opening, negatively affecting the efficiency of the trimmer. Increasing the number of external cutting teeth 16 also increases the potential for deformation of such teeth away from rotational axis R of the rotary cutting device 1 (FIG. 7A–7B). Alternatively, fewer external cutting teeth 16, while providing larger openings 18, also provide fewer external cutting edges 30,32.

Figure 6B:
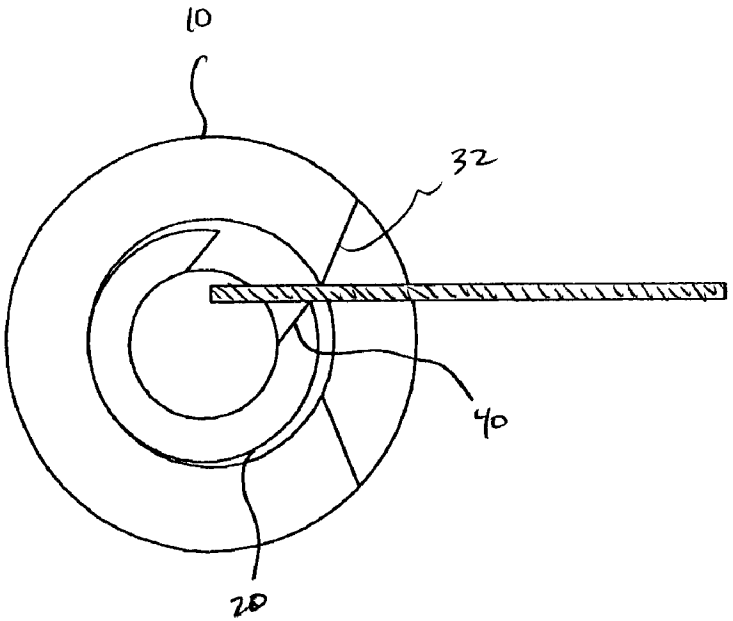
FIG. 6B (PRIOR ART)
FIGS. 6A, 6B, 7A, and 7B are somewhat schematic end views of a prior art rotary hair trimmer cutting a hair.
Figure 6A:
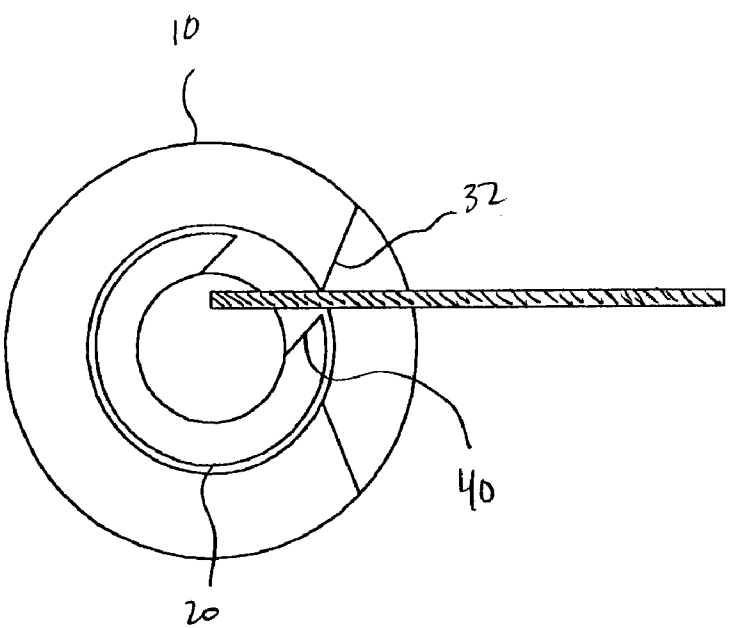
FIG. 6A (PRIOR ART)

Similarly, the number of internal cutting teeth 26 must be considered. A high number of internal teeth 26 results in partial occlusion of the external openings 18, reducing the pickup of material to be cut. A greater number of internal cutting teeth 26 also reduces internal cutting tooth 26 cross-section and therefore rigidity, increasing the risk of inward deformation (FIGS. 6A–6B).

Finally, the number of internal cutting teeth 26 affects the width of internal openings 28. Cutting efficacy is optimized if internal openings 28 are wider than external cutting teeth 16, as this allows external teeth 16 to drop into internal openings 28 during operation, allowing scissoring action rather than a guillotine action.

Each alignment instance produces a slight frictional resistance, or "catching" of the heads, during rotation. This resistance must be overcome by the rotational force provider, (e.g. motor, manual). Minimization of such instances of alignment results in lower overall frictional resistance of the cutting heads.

For manual (non-motor) applications of the present rotary cutting device, reduced rotational resistance facilitates smoother operation with less inadvertent movement of the trimmer during use. Hairs are more readily cut and less prone to being pulled by the user, and the risk on accidental injury likewise is decreased.

Returning to FIGS. 4–5, it can be seen that leading cutting edge 30 and trailing cutting edge 32 are angled relative to axis of rotation R. Arranging cutting edges 30,32 at non-zero axial rake angles $\theta_{EXT}$ (FIG. 11) promotes a scissors-like cutting action and reduces the cutting force necessary for cutting hairs.

Greater cutting efficiency translates to less pulling of the material to be cut. For hair trimmers, this more efficient action reduces pain or discomfort associated with pulling of a hair while cutting, as commonly occurs in conventional designs or with dull cutting edges.

A common feature of rotary trimmers is the employment of positive radial rake angles (sharp or acute angles on the edges, as seen from the end) of the cutting edges. While sharper radial rake angles generally will yield more efficient cutting, they also typically lead to more rapid wear.

Figure 11:
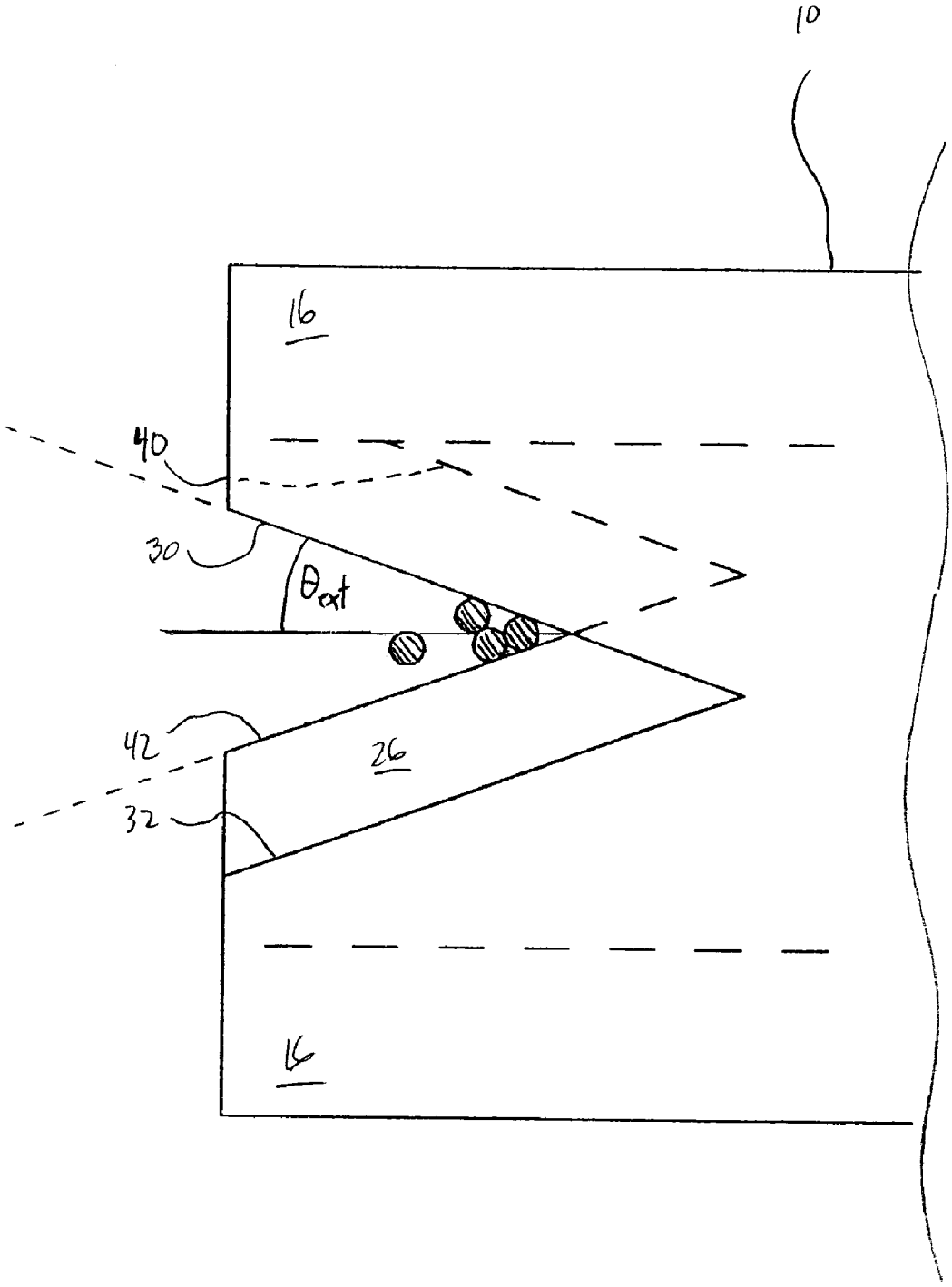
FIG. 11 is a somewhat schematic view of a rotary hair trimmer constructed according to the present disclosure with a plurality of hairs positioned for cutting.

Related to cutting efficiency and the minimization of cutting pressure, it is desirable to have a non-zero combined axial rake angle. That is, it is desirable that leading cutting edges 30 and 42 be non-parallel, as shown in FIG. 11. This inequality increases the overall rake angle of the cutting surfaces—i.e., the angle at which the planar cutting surfaces present themselves to the material being cut. This overall rake angle could instead be increased by increasing the radial rake angles, but this would accelerate wear. By tilting these cutting surfaces in the other axis, cutting efficiency can be improved without accelerating wear.

A non-zero combined axial rake angle further allows for true scissors action, which will provide superior performance in cutting relatively soft, thin objects like hairs.

Figure 10:
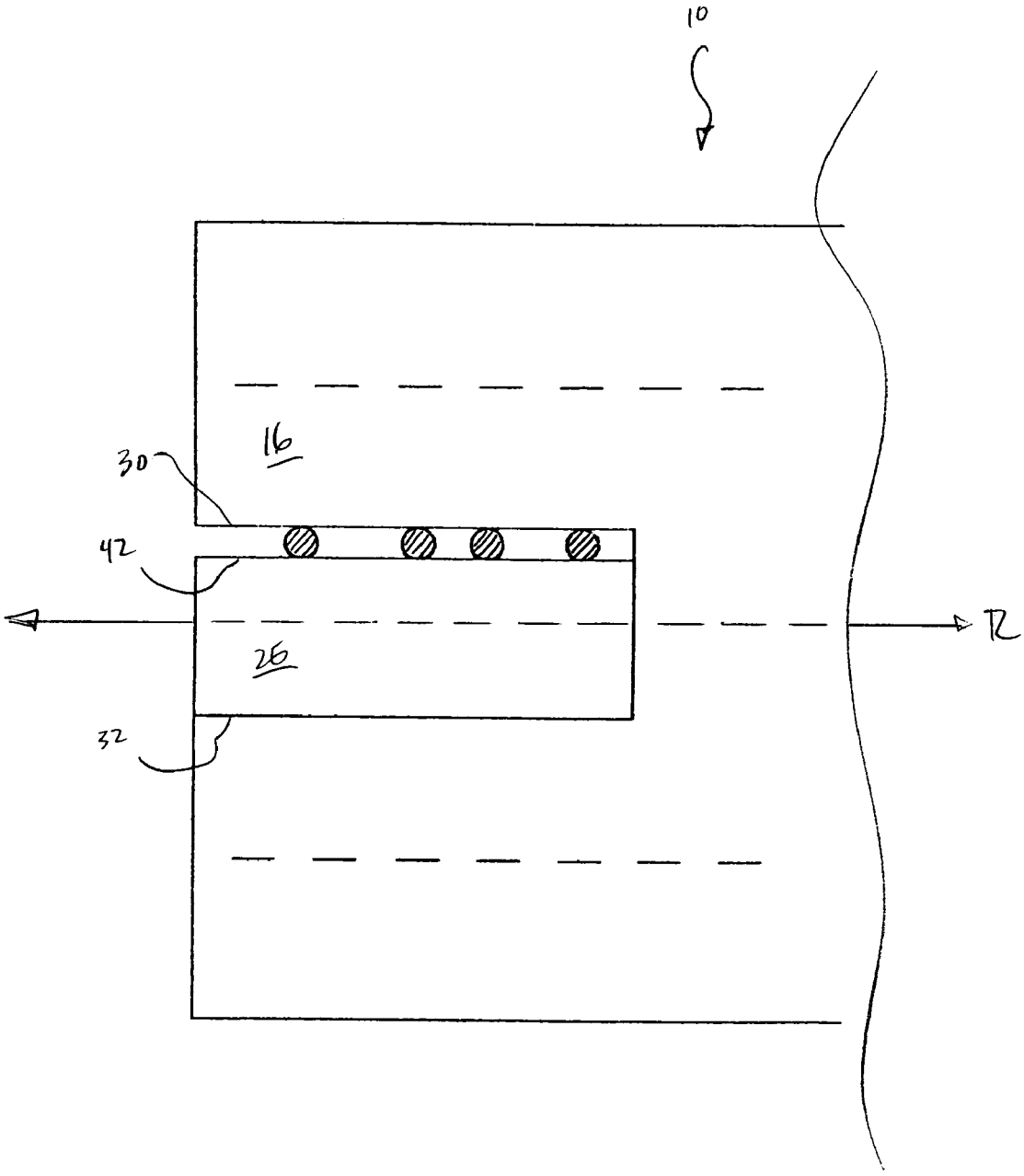
Fig. 10 (PRIOR ART)
FIG. 10 is a somewhat schematic partial view of a rotary hair trimmer of the prior art with a plurality of hairs positioned for cutting.

A non-zero combined axial rake angle also avoids the situation shown in FIG. 10, in which multiple hairs might be cut simultaneously by one pair of cutting edges 30,42, increasing local cutting pressure and both modes of tooth deflection (shown in FIGS. 6B and 7B), leading to increased clearance between cutting elements and inefficient cutting.

Figure 8A:
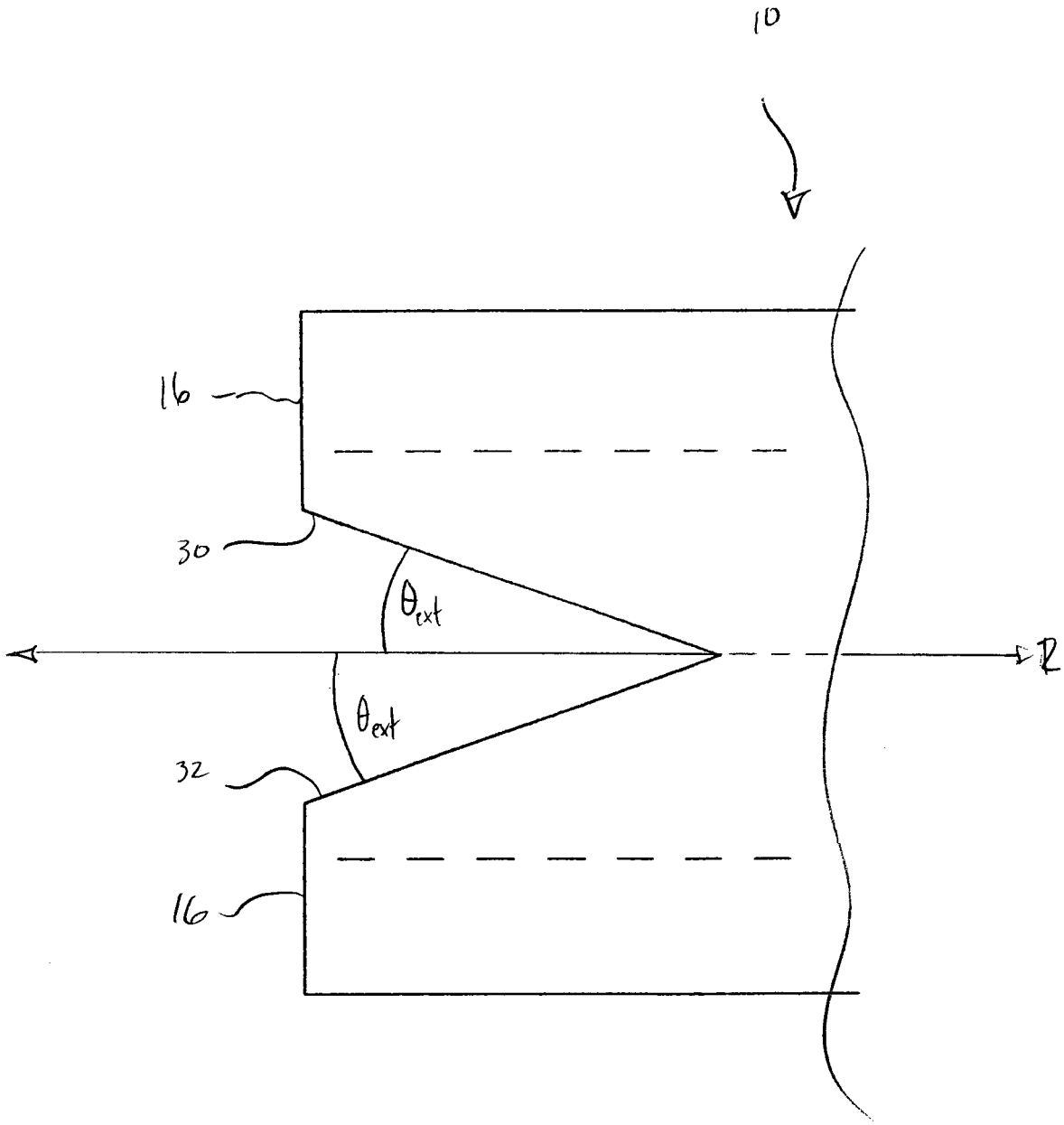
FIG. 8A (PRIOR ART)
FIG. 8A is an enlarged partial view of an external cutting head of a general rotary trimmer showing the blade geometry thereof.
Figure 8B:
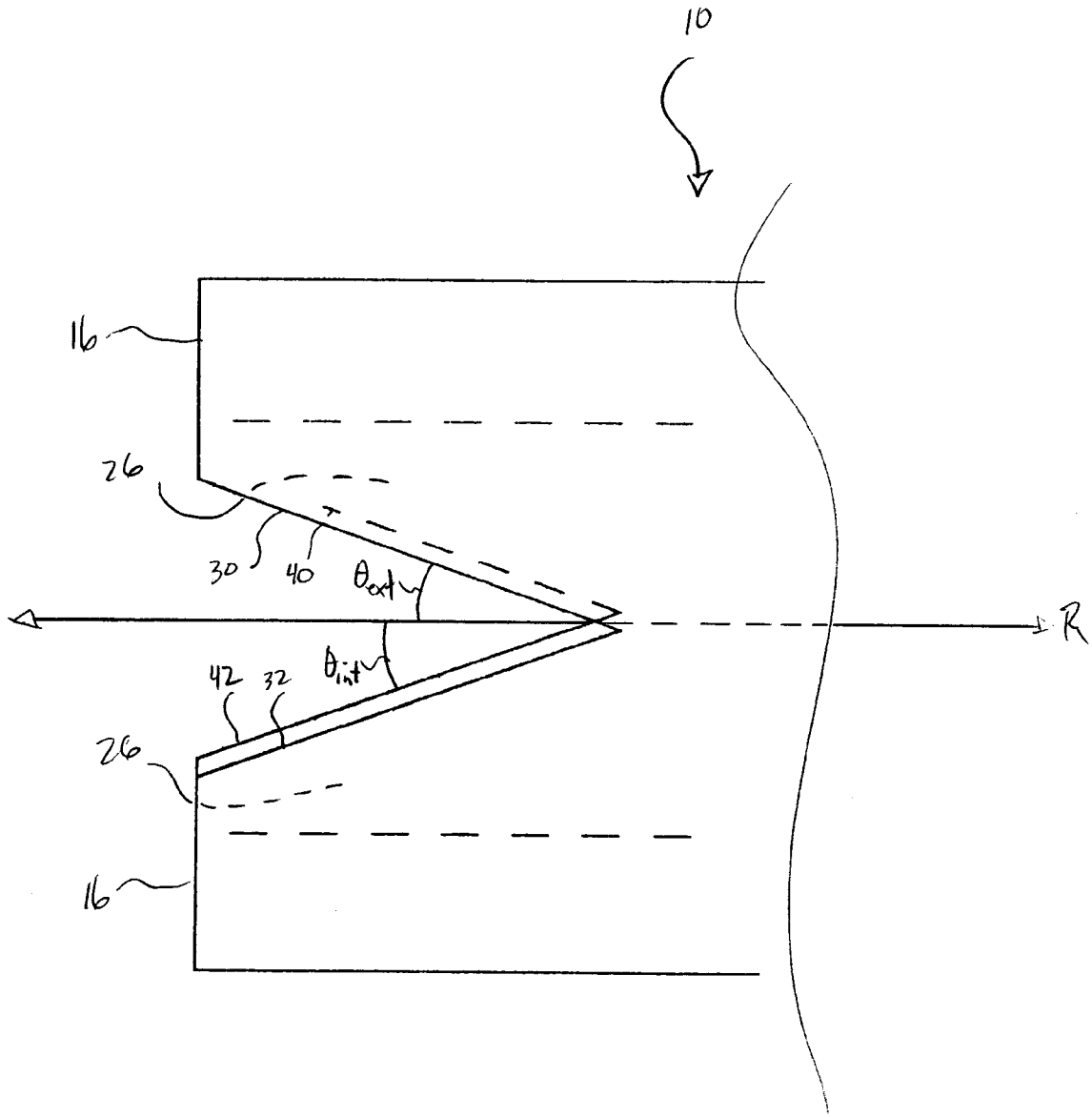
FIG. 8B (PRIOR ART)
FIG. 8B is an enlarged partial view of a prior art rotary trimmer showing the external and internal cutting heads.

Further to the concept of cutting edge alignment leading to rotational resistance, it also is desirable that cutting edges 30,32 have non-equal axial rake angles $\theta_{EXT}$. As can be seen more clearly in FIGS. 8A–8B, cutting teeth 16 includes cutting surfaces 30,32 which, having equal axial rake angles $\theta_{EXT}$, will align during rotation of external cutting head 10 about internal cutting head 20. Such alignment leads to resistance or "sticking," as friction between cutting edges 30,32 retards rotation. Burrs left on cutting edges 30,32 can exacerbate this phenomenon.

Figure 9:
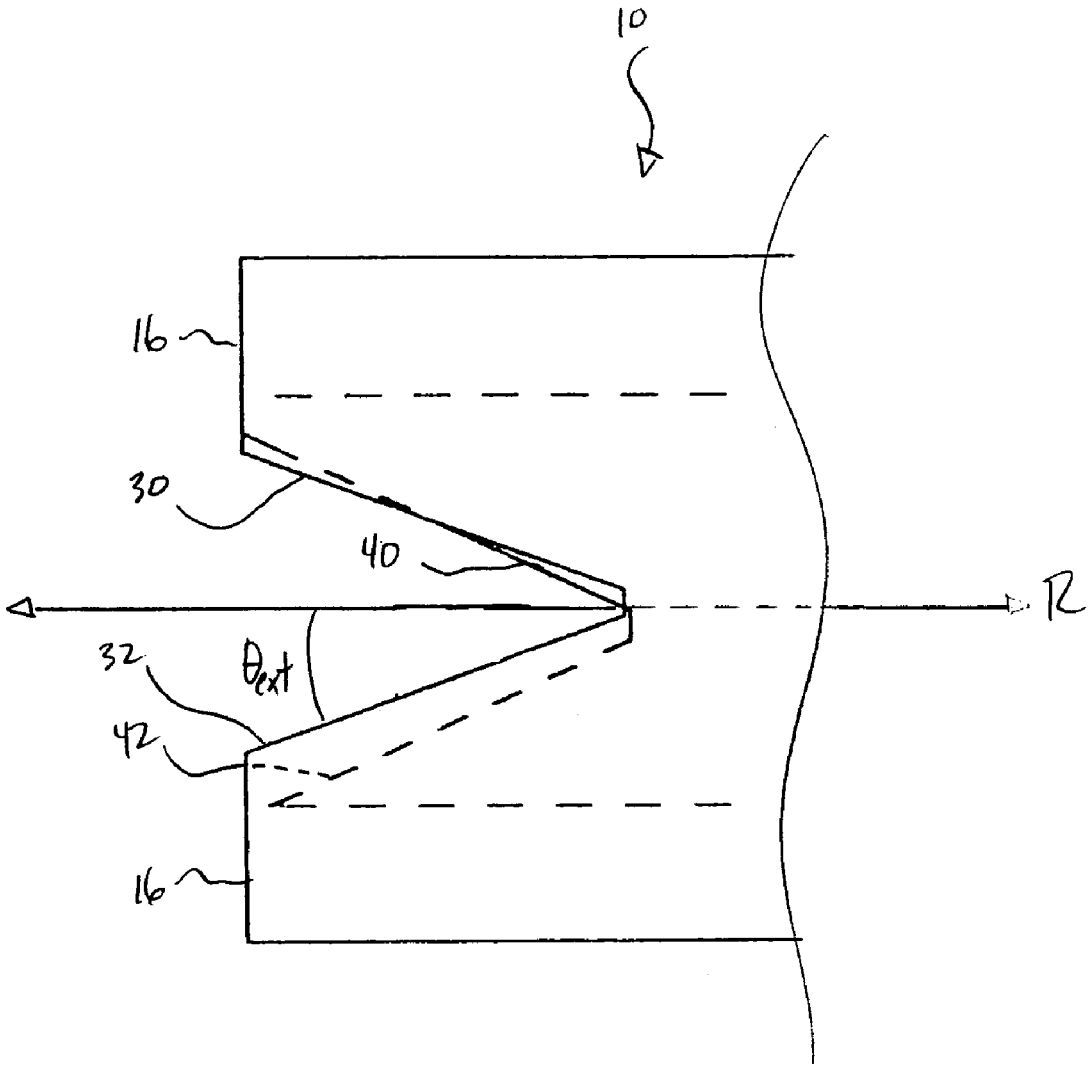
FIG. 9 is a side sectional view diagram of the cutting heads of a rotary trimmer constructed according to the present disclosure, showing the external and internal cutting heads.

As shown in FIG. 9, cutting edge 30 of the external cutting head 10 and cutting edge 40 of the internal cutting head 20 preferably are non-parallel, i.e., non-alignable, in the present rotary cutting device. As well, cutting edge 32 of head 10 and cutting edge 42 of head 20 likewise are preferably non-alignable. The extent of non-alignment can range from |±1| to |±5| degrees and is preferably |±2–3| degrees.

Such non-alignable orientation means that trailing edges will intersect leading edges at a point rather than in a line, increasing smoothness of operation (i.e., reducing that intermittent points at which more torque is required to operate the trimmer). Smoother function reduces the likelihood of the user moving the stationary rotary cutting device during operation, reducing the likelihood of pulled hairs. For a powered rotary cutting device, smoother function translates to less power needed and less wear on the drive mechanism.

In some applications, it can be advantageous to bore inside diameter $ID_{EXT}$ of external head 10 so that this ID is just slightly larger than outer diameter $OD_{INT}$ of internal head 20. In other applications, like in those involving cutting hair, it is advantageous to then slightly deform external teeth 16, reducing bore $ID_{EXT}$ at this point so that bore $ID_{EXT}$ is actually smaller than the outer diameter $OD_{INT}$ of internal head 10. After assembly, external teeth 16 will then push against the internal head 20 with spring tension; during operation, external teeth 16 will actually drop into openings 28 in internal head 20.

Such slight deformation of external cutting teeth 16 provides a small tolerance between external teeth 16 and internal teeth 26, improving the scissors action of the cutting edges.

The present invention further provides a method for manufacturing cutting elements for a rotary cutting device.

External or outer head 10 is provided, having a central bore 14 with $ID_{external}$ and a plurality of teeth 16 circularly disposed in a cutting region thereon.

A mandrel is positioned within the central bore 14 at least in the cutting region, i.e. the region in which cutting teeth 16 are disposed. The mandrel has an outside diameter $OD_{INT}$.

The plurality of teeth 16 in the cutting region then are bead-blasted. The bead-blasting process generally is known in the art. Bead-blasting the cutting region of the external head 10 involves holding and rotating external head 10 under a nozzle through which flows a pressurized stream of air and blasting media (usually glass beads). The nature and size of this media, and the pressure and velocity of the air stream, will influence the degree to which the substrate will be blasted or peened, and the nature of the end result.

The mandrel is then removed from the central bore 14, and the rotary cutting device 1 assembled by insertion of an internal cutting head 20 in the central bore 14.

Bead-blasting of the external cutting head 10 serves to reduce the separation distance between the surface defining central bore 14 of the cutting region and the outside surface of the mandrel, i.e., to reduce the central bore 14 of the cutting region, reducing the clearance between external cutting head 10 and internal cutting head 20. This reduction is accomplished by the slight and non-transient deformation of external teeth 16 inward toward rotational axis R. During bead-blasting, it is believed that the edges of teeth 16 are peened inward and against the mandrel, with such peening being retained in external teeth 16 after the bead-blasting step.

The bead-blasting process also sharpens cutting edges 40,32 of external cutting teeth 16 and produces serrations thereon.

It can be appreciated that the hardness rating and ductility of the material from which the external head is constructed can bear upon the degree to which external head-internal head clearance is adjusted. A variety of materials can be efficaciously employed, e.g., 300 series and 400-series stainless steel, alloy steels, brass.

Bead-blasting of the leading and/or trailing cutting edges 30,32 results in an unexpected and marked improvement in the cutting action of a rotary cutting device so treated.

Figure 1A:
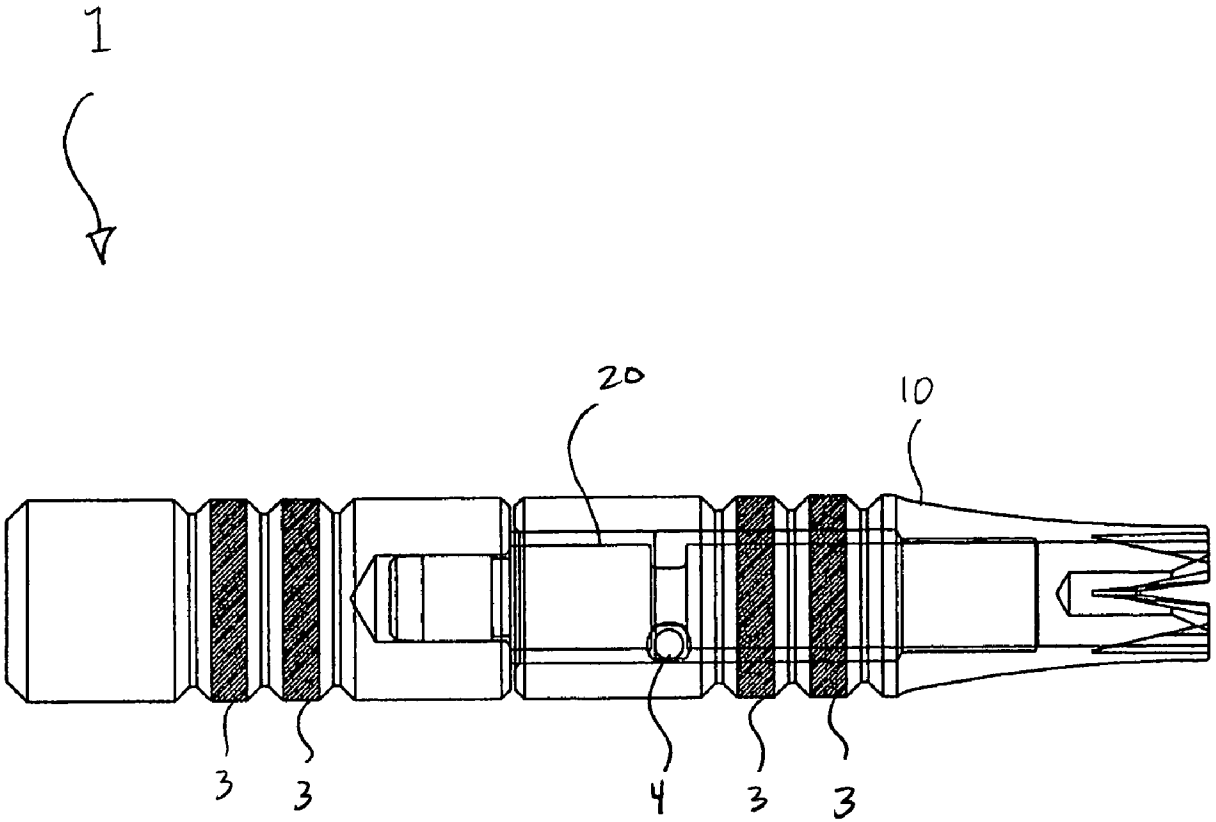
Figure 2B:
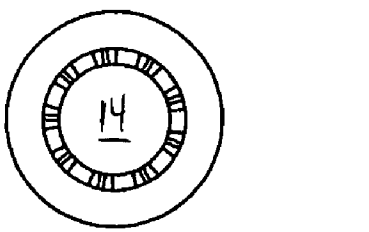
FIGS. 2A–2B are side and end view diagrams, respectively, of the external head of FIGS. 1A–1B.
Figure 2A:
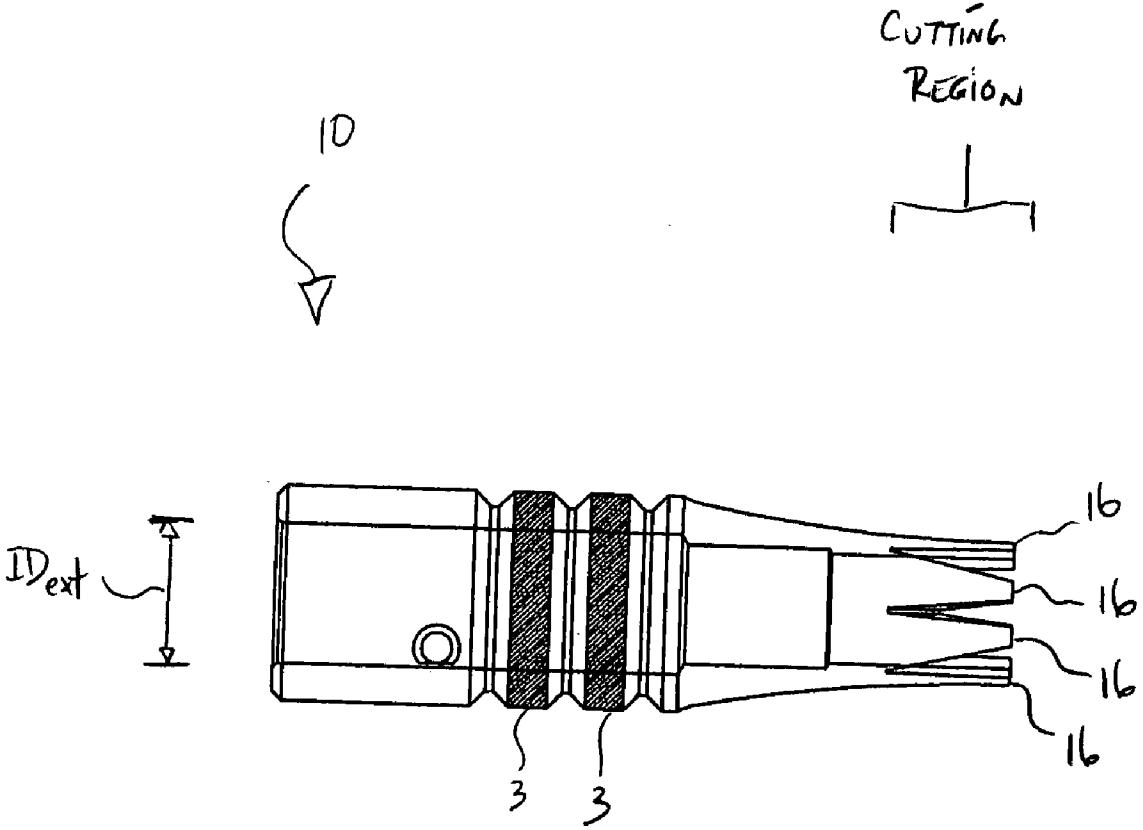
Figure 3B:
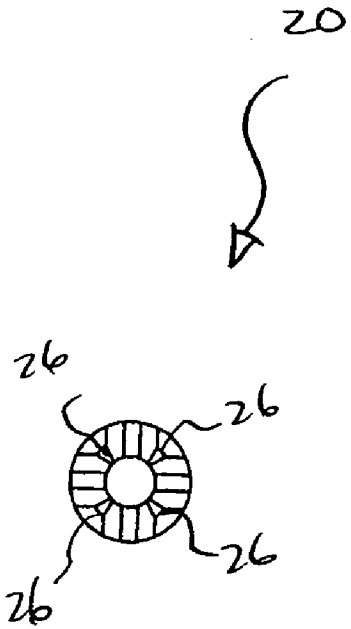
FIGS. 3A–3B are side and end view diagrams, respectively, of the internal head of FIGS. 1A–1B.
Figure 3A:
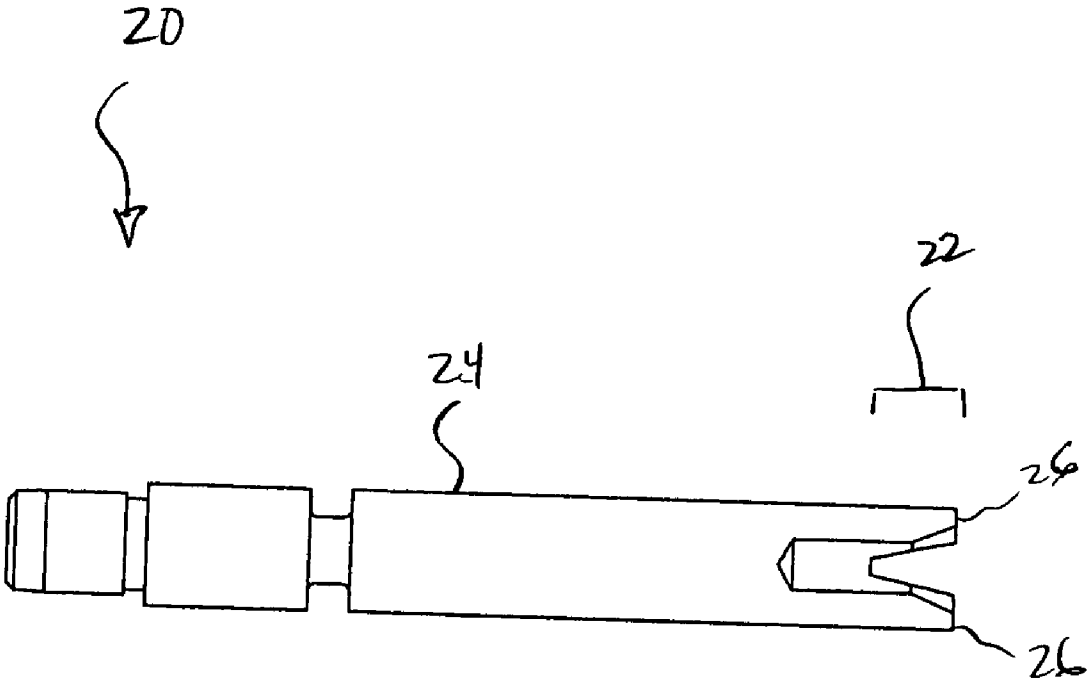

In proof of principle, external cutting head 10 was constructed of 303 stainless steel, treated as described above and assembled into a rotary cutting device similar to that depicted in FIG. 1A. The cutting action of this prototype was determined to be surprisingly improved compared to cutting devices constructed using traditional cutting edge honing techniques. As well, the play between the external cutting head 10 and internal cutting head 20 was substantially reduced compared to rotary cutting devices of the prior art, which reduction could be readily detected upon manual operation of the device.

A person skilled in the art will be able to practice the present invention in view of the description present in this document, which is to be taken as a whole. Numerous details have been set forth in order to provide a more thorough understanding of the invention. In other instances, well-known features have not been described in detail in order not to obscure unnecessarily the invention.

While the invention has been disclosed in its preferred form, the specific embodiments thereof as disclosed and illustrated herein are not to be considered in a limiting sense. Indeed, it should be readily apparent to those skilled in the art in view of the present description that the invention can be modified in numerous ways. The inventor regards the subject matter of the invention to include all combinations and sub-combinations of the various elements, features, functions and/or properties disclosed herein.

What is claimed is:

1. A rotary hair trimmer, comprising:

a first cutting head including 4 first cutting teeth circularly arrayed thereon, each of said first cutting teeth including a first leading cutting edge disposed thereon at a first leading axial rake angle relative to a rotational axis of the first head and a first trailing cutting edge disposed thereon at a first trailing axial rake angle relative to the rotational axis of the first head; and a second cutting head rotatably arranged relative to said first cutting head and including a number selected from the group consisting of 5, 7, 9, and 11 of second cutting teeth circularly arrayed thereon, each of said second cutting teeth including a second leading cutting edge disposed at a second leading axial rake angle relative to a rotational axis of the second head and a second trailing cutting edge disposed at a second trailing axial rake angle relative to the rotational axis of the second head;

wherein said first leading axial rake angle is different from said second trailing axial rake angle;

wherein said second leading axial rake angle is different from said first trailing axial rake angle.

2. The rotary hair trimmer of claim 1 wherein:

a difference between said first leading axial rake angle and said second trailing axial rake angle is in the range of 1–5 degrees; and a difference between said second leading axial rake angle and said first trailing axial rake angle is in the range of 1–5 degrees.

3. The rotary hair trimmer of claim 1 wherein:

a difference between said first leading axial rake angle and said second trailing axial rake angle is in the range of about 2 to 3 degrees; and a difference between said second leading axial rake angle and said first trailing axial rake angle is in the range of about 2 to 3 degrees.

4. The rotary hair trimmer of claim 1 wherein each of said first leading axial rake angle and said second trailing axial rake angle is not equal to 0 degree.

5. The rotary hair trimmer of claim 4 wherein each of said second leading axial rake angle and said first trailing axial rake angle is not equal to 0 degree.

6. The rotary hair trimmer of claim 1 wherein each of said second leading axial rake angle and said first trailing axial rake angle is not equal to 0 degree.

7. The rotary hair trimmer of claim 6 wherein each of said first leading axial rake angle and said second trailing axial rake angle is not equal to 0 degree.

8. The rotary hair trimmer of claim 1, further comprising:

an inner bore of said first cutting head, said inner bore having a diameter substantially equal to an outside diameter of said second cutting head.

9. A rotary cutting device, comprising:

a first cutting head including 4 first cutting teeth circularly arrayed thereon, each of said first cutting teeth including a first cutting edge; and a second cutting head rotatably arranged relative to said first cutting head and including a number selected from the group consisting of 5, 7, 9, and 11 of second cutting teeth circularly arrayed thereon, each of said second cutting teeth including a second cutting edge;

wherein said first and second cutting teeth are disposed such that rotation of the first and second cutting heads can substantially align no more than one first cutting edge with one second cutting edge.

10. A rotary cutting device comprising:

an outer cutting head having:

a cylindrical structure with an internal bore, and a number selected from the group consisting of 5, 7, 9, and 11 of outer teeth arrayed at an outer head end thereof; and an inner cutting head having 4 inner teeth arrayed at an inner head end thereof.

11. The rotary cutting device of claim 10 wherein the number of the outer teeth is 9.

12. A rotary cutting device comprising:

an outer cutting head having:

a cylindrical structure with an internal bore, and a number selected from the group consisting of 4, 5, 7, 8, 10, and 11 of outer teeth arrayed at an outer head end thereof; and an inner cutting head having 3 inner teeth arrayed at an inner head end thereof.

13. A rotary cutting device comprising:

an outer cutting head having:

a cylindrical structure with an internal bore, and a number selected from the group consisting of 4, 6, 7, 8, 9, and 11 of outer teeth arrayed at an outer head end thereof; and an inner cutting head having 5 inner teeth arrayed at an inner head end thereof.

14. A rotary cutting device, comprising:

a first cutting head including 3 first cutting teeth circularly arrayed thereon, each of said first cutting teeth including a first cutting edge; and a second cutting head rotatably arranged relative to said first cutting head and including a number selected from the group consisting of 4, 5, 7, 8, 10, and 11 of second cutting teeth circularly arrayed thereon, each of said second cutting teeth including a second cutting edge;

wherein said first and second cutting teeth are disposed such that rotation of the first and second cutting heads can substantially align no more than one first cutting edge with one second cutting edge.

15. A rotary cutting device, comprising:

a first cutting head including 5 first cutting teeth circularly arrayed thereon, each of said first cutting teeth including a first cutting edge; and a second cutting head rotatably arranged relative to said first cutting head and including a number selected from the group consisting of 4, 6, 7, 8, 9, and 11 of second cutting teeth circularly arrayed thereon, each of said second cutting teeth including a second cutting edge;

wherein said first and second cutting teeth are disposed such that rotation of the first and second cutting heads can substantially align no more than one first cutting edge with one second cutting edge.

* * * * *